US011454921B2

(12) United States Patent
Moon et al.

(10) Patent No.: US 11,454,921 B2
(45) Date of Patent: Sep. 27, 2022

(54) CONTACTS FOR A PRINT PARTICLE INPUT RECESS

(71) Applicant: HEWLETT-PACKARD DEVELOPMENT COMPANY, L.P., Spring, TX (US)

(72) Inventors: Ji-Won Moon, Pangyo (KR); Min-Chul Lee, Pangyo (KR); Kwangsung Park, Pangyo (KR); Yuntae Kim, Pangyo (KR); Jinwoo Noh, Pangyo (KR); Matthew James Storey, Austin, TX (US); Seungsup Lee, Suwon (KR); Zackary Thomas Hickman, Austin, TX (US); Amy Moon Williams, Austin, TX (US); An Tran, Austin, TX (US); Bennett Alexander Nadeau, Austin, TX (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/050,136

(22) PCT Filed: Aug. 30, 2018

(86) PCT No.: PCT/US2018/048849

§ 371 (c)(1),
(2) Date: Oct. 23, 2020

(87) PCT Pub. No.: WO2020/046339

PCT Pub. Date: Mar. 5, 2020

(65) Prior Publication Data

US 2021/0096503 A1 Apr. 1, 2021

(51) Int. Cl.
*G03G 15/00* (2006.01)
*G03G 21/16* (2006.01)
*G03G 15/08* (2006.01)

(52) U.S. Cl.
CPC ..... *G03G 21/1652* (2013.01); *G03G 15/0863* (2013.01)

(58) Field of Classification Search
CPC ..... G03G 15/0863; G02G 21/1652
(Continued)

(56) References Cited

U.S. PATENT DOCUMENTS 5,797,073 A * 8/1998 Russell ..... G03G 15/0886 222/167
6,168,262 B1 1/2001 Clark et al.
(Continued)

FOREIGN PATENT DOCUMENTS

EP 2261751 A2 12/2010
EP 2367068 A2 9/2011
(Continued)

*Primary Examiner* — Hoan H Tran
(74) *Attorney, Agent, or Firm* — Staas & Halsey LLP

(57) ABSTRACT

Examples of a host device that includes an input recess are described. In some examples, the input recess includes a rotating port cover offset from a central axis of the input recess. In some examples, the input recess includes a plurality of contacts disposed on an interfacing surface of the input recess to interface with a print particle replenishment device when the rotating port cover is rotated. In some examples, the plurality of contacts interfaces with a control device to authenticate the print particle replenishment device.

16 Claims, 6 Drawing Sheets

(58) Field of Classification Search
USPC ..... 399/12, 107, 111, 119, 120, 252, 262
See application file for complete search history.

(56) References Cited

U.S. PATENT DOCUMENTS

| | | | |
|---|---|---|---|
| 7,513,598 | B2 | 4/2009 | Silverbrook |
| 9,164,425 | B2 | 10/2015 | Buchanan et al. |
| 9,815,289 | B2 | 11/2017 | Ness et al. |
| 2005/0157037 | A1 | 7/2005 | Silverbrook et al. |
| 2008/0252700 | A1 | 10/2008 | Silverbrook |
| 2016/0195833 | A1 | 7/2016 | Acosta et al. |

FOREIGN PATENT DOCUMENTS

| | | | | |
|---|---|---|---|---|
| JP | 2004145170 | | * | 5/2004 |
| JP | 2009262570 | A | | 11/2009 |
| WO | WO2011155642 | A1 | | 12/2011 |

* cited by examiner

CONTACTS FOR A PRINT PARTICLE INPUT RECESS

CROSS-REFERENE TO RELATED APPLICATIONS

This application is a U.S. National Stage Application which claims the benefit under 35 U.S.C. § 371 of International Patent Application No. PCT/US2018/048849 filed on Aug. 30, 2018, the contents of which are incorporated herein by reference.

BACKGROUND

Some types of printing utilize print particles, such as print toner or powder. For example, three-dimensional (3D) printing may utilize one or more kinds of print particles. In some examples of 3D printing, 3D solid parts may be produced from a digital model using an additive printing process. 3D printing may be used in rapid prototyping, mold generation, mold master generation, and short-run manufacturing. Some 3D-printing techniques are considered additive processes because they involve the application of successive layers of build material. In some 3D-printing techniques, the build material may be cured or fused. Laser jet printing may utilize print toner. For example, a printer may cause toner particles to be fused to a piece of paper.

DETAILED DESCRIPTION

Figure 1:
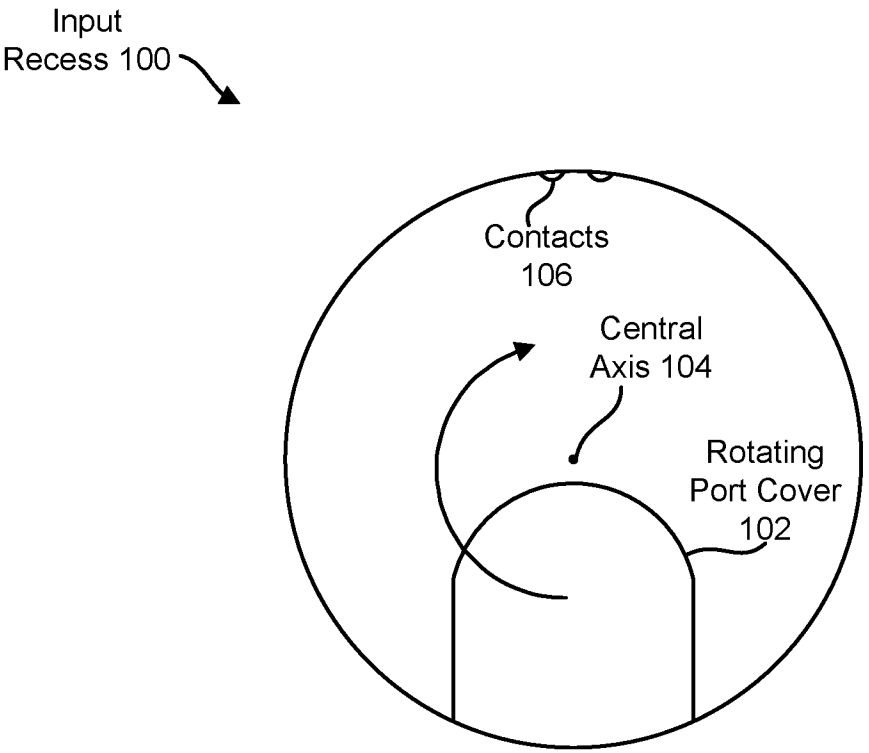
FIG. 1 is top elevational view of an example of a print particle input recess.

Some printing technologies utilize print particles. Examples of print particles include three-dimensional (3D) print powder and toner. In some examples, an average diameter of 3D print powder particles of this disclosure may be less than 50 microns and/or an average diameter of toner particles of this disclosure may be less than 20 microns. It should be noted that in some examples, some print particles may be round, approximately round, or non-round. Print particles may become airborne and contaminate the environment if not controlled. Control may be difficult when print particle bottles are supplied to inexperienced users in environments like offices or homes (e.g., home offices). Flow characteristics of particles may be harder to predict than, for example, fluids. As can be observed from this discussion, devices and techniques that enable cleaner and simpler transfer of print particles may be beneficial.

Ensuring transfer of authentic print particles may also be beneficial. For example, preventing the use of print particles that perform worse or that are incompatible with a printer may be beneficial.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

FIG. 1 is top elevational view of an example of a print particle input recess 100. Examples of the print particle input recess 100 include printer refill interfaces and cartridge refill interfaces. The print particle input recess 100 may receive print particles. For example, the print particle input recess 100 may be designed to interface with a print particle replenishment device (e.g., print particle bottle, print particle refill container, etc.). In some examples, the input recess 100 may be part of or may be coupled to a host device. For example, a host device may include and/or be coupled to the input recess 100. A host device is a device that uses and/or applies print particles. Examples of a host device include printing devices, printers, and print cartridges. For example, it may be beneficial to replenish or refill a printer and/or print cartridge with print particles. For instance, a host device may have a useful life beyond use of a reservoir of print particles. Accordingly, it may be beneficial to replenish the reservoir in a host device with print particles rather than replacing the host device.

In some examples, the input recess 100 includes a recess (e.g., depression, cavity, bay, indentation, etc.). For example, the input recess 100 may be recessed from an uppermost portion of the input recess 100. One end (e.g., the top end) of the input recess 100 may be open for insertion of a print particle replenishment device.

In the example illustrated in FIG. 1, the input recess 100 includes a rotating port cover 102. The rotating port cover 102 may cover an input port of the input recess 100 when in a closed position. In some examples, the rotating port cover 102 may be offset from a central axis 104 of the input recess 100.

The input recess 100 may include one or more contacts 106 (e.g., a plurality of contacts 106) disposed on an interfacing surface of the input recess 100. The contact(s) 106 may be adapted to interface with a print particle replenishment device when the rotating port cover 102 is rotated (e.g., in an open position). In some examples, the contacts 106 may be disposed on a plane that is parallel to the central axis 104 or parallel to a flow direction of print particles.

In some examples, the contact(s) 106 may interface with a control device to authenticate the print particle replenishment device. For example, the contact(s) 106 may be in electronic communication with the control device. Examples of the control device include a processor, microcontroller, field programmable gate array (FPGA), integrated circuitry, etc. In some examples, the contact(s) 106 may be wired to the control device, may be part of the control device, and/or may be coupled to circuitry in communication with the control device. In some examples, the control device may be part of or included in the host device (e.g., cartridge and/or printer).

In some examples, the input recess 100 may be cylindrical in shape. In some examples, the input recess 100 may have another shape (e.g., polygonal, irregular, prismatic, etc.). A "cylindrical input recess" may be an example of the input recess 100 that is cylindrical in shape (e.g., internally cylindrical). As used herein, the term "cylindrical" may mean approximate conformity to a cylinder shape. For example, a cylindrical input recess may include one or more portions that conform to or approximate a cylinder shape. For instance, a cylindrical input recess may include one or more outer curved sections and/or an approximately circular end or base.

The contact(s) 106 may be electrical contacts (e.g., electrical structures, plates, prongs, etc.) for interfacing with (e.g., touching) counterpart contact(s) on the print particle replenishment device. For example, the contacts 106 may be metallic contacts capable of communicating electrical or electronic signals. The contact(s) 106 may be disposed on an interfacing surface (e.g., inner portion) of the input recess 100. It should be noted that although the contacts 106 are illustrated as being disposed on a side (e.g., curved) portion of the input recess 100, contact(s) 106 may additionally or alternatively be disposed on an end portion (e.g., bottom portion, planar portion) of the input recess 100. In an example, one or more contacts 106 may be disposed on a side portion of the input recess 100 and one or more other contacts 106 may be disposed on an end (e.g., bottom portion) of the input recess 100.

It should be noted that the contacts 106 may be located at any displacement relative to the port or rotating port cover 102 (when in a closed position, for instance). For example, contact(s) 106 may be located on an opposite side (e.g., centered at 180 degrees) relative to the port or rotating port cover 102 angle (from the central axis 104, for example), on a same side (e.g., centered at 0 degrees) relative to the port or rotating port cover 102 angle, laterally from the port or rotating port cover 102 angle (e.g., centered at 90 degrees and/or −90 degrees relative to the port or rotating port cover 102 angle), and/or at other dispositions. In some examples, the contact(s) 106 may be disposed within the same input recess 100 as the port (e.g., next to the port, near the port, etc.).

As described herein, a number of contacts 106 may be implemented. The contact(s) 106 may be utilized to interface with a memory device and/or electronic circuitry (e.g., integrated circuit) for authentication and/or dispense detection. Examples of contacts 106 include a ground contact, a power supply contact, a signal contact, a clock contact, and chip select contact. In some examples, multiple signal contacts may be utilized (e.g., a signal contact for one or more authentication signals (e.g., authentication data) and a signal contact for one or more dispense detection signals (e.g., dispense detection data)) or a single signal contact may be utilized (e.g., a signal contact for authentication signal(s) and/or dispense detection signal(s)).

In some examples, there may be two contacts 106: a ground contact and a signal contact. Two contacts may be implemented for an example of a "single-wire" interface. In some examples, there may be three contacts 106: a power supply (e.g., Vcc) contact, a ground contact, and a signal contact. Three contacts may be implemented for another example of a "single-wire" interface. In some examples, there may be four contacts 106: a power supply (e.g., Vcc) contact, a ground contact, a clock contact, and a signal contact. Four contacts may be implemented for a four-wire interface. In some examples, there may be five contacts 106: a power supply (e.g., Vcc) contact, a ground contact, a clock contact, a chip select contact, and a signal contact. Five contacts may be implemented for a five-wire interface. One or more additional wires and/or contact pads may be added to the foregoing examples.

In some examples, one or more of the contacts 106 may be utilized for authentication and/or dispense detection. For example, authentication and/or dispense detection signals may be received via a signal contact. In other examples, separate contacts may be utilized for authentication and dispense detection. For example, three contacts may be implemented: a ground contact, an authentication signal contact, and a dispense detection signal contact.

In some examples, a print particle replenishment device circuit (e.g., memory device and/or integrated circuit) may connect to contacts 106 for a host device (e.g., printer, cartridge, etc.). The host device may have a different circuit (e.g., memory device and/or integrated circuit for authentication). In some examples, the host device may have a set of contacts 106 to route wires from the print particle replenishment circuit and/or the host device circuit (e.g., cartridge authentication circuit) to a printer circuit (e.g., a printed circuit assembly (PCA), formatter board, etc.).

In some examples, the print particle replenishment device circuit (e.g., print particle replenishment device authentication integrated circuit) and a cartridge circuit (e.g., cartridge authentication circuit) may share wires and/or contacts. For example, a print particle replenishment device authentication integrated circuit may be connected (with two wires on the print particle replenishment device, for example) to two contacts 106. In an example, the two contacts 106 may be connected to a cartridge authentication circuit, which may be connected to two contact pads on the cartridge. The cartridge contact pads may be connected to contacts for a PCA on a printer. The cartridge contacts may be examples of the contact interfaces 328, 428 described in connection with FIG. 3B and FIG. 4B.

In some examples, a contact interface may include a dispense detection signal contact, a dispense detection ground contact, an authentication signal contact (for replenishment device authentication and/or host device authentication, for example), and an authentication ground contact. The dispense signal contact may carry a dispense indication signal and/or dispense indication data. The authentication signal contact may carry an authentication signal. In some examples, the contact interface may include a dispense detection signal contact, a dispense detection ground contact, a replenishment device authentication signal contact, a replenishment device authentication ground contact, a host device authentication signal contact, and a host device authentication ground contact.

In some examples, the contact(s) 106 may be adapted to rotate with the rotating port cover 102. For example, a side portion of the input recess 100 may be adapted to rotate with a print particle replenishment device. When the input recess 100 or a portion of the input recess 100 rotates, the contact(s) 106 may rotate with the rotating port cover 102. In some examples, the contact(s) 106 may maintain connection and/or contact with corresponding or counterpart contact(s) on the print particle replenishment device during rotation of the input recess 100. For example, contact between the input recess 100 and the print particle replenishment device may be made via a location on a locking ring of the input recess 100 (e.g., a host device receptacle) to maintain constant contact through the entire refill process. Contacts or contact pads that rotate may be referred to as "orbiting contacts." In some examples, a side portion of the input recess 100 may be adapted to rotate with the print particle replenishment device while a bottom portion of the input recess 100 is static.

In some examples, one or more of the contacts 106 may not maintain contact during rotation. For instance, the contact(s) 106 may provide or have intermittent connection and/or contact with corresponding or counterpart contact(s) on the print particle replenishment device. For example, an intermittent contact may have an intermittent connection when the print particle replenishment device (e.g., print particle replenishment device contact(s)) is in one or more certain orientations. In some examples, the contact(s) 106 may have contact before rotation and/or after rotation, but not during rotation.

In some examples, the contact(s) 106 may be situated to interface with a protruding structure of an outer portion of the print particle replenishment device. For example, a planar structure may protrude from the curved (e.g., side) portion of the print particle replenishment device. The planar structure may be tangent to the curved portion (e.g., side) of the print particle replenishment device. In some examples, the protruding structure may engage a rotating portion of the input recess 100.

In some examples, the contact(s) 106 may be adapted to rotate with a portion of the input recess 100 (e.g., the rotating port cover 102) when opening a port of the input recess 100. For example, the input recess 100 may be adapted to open the port when the rotating port cover 102 is rotated relative to a port of the input recess 100. The port may be an opening through which print particles may be transferred or delivered. It should be noted that the rotating port cover 102 may be implemented in one or more shapes. In the example illustrated in FIG. 1, the rotating port cover 102 has a projecting (e.g., peninsular) shape, where the rotating port cover 102 projects or extends inward in the input recess 100 from a side of the input recess 100. In other examples, the rotating port cover 102 may have different shapes and/or locations. For example, the rotating port cover 102 may be a circle, ellipse, kidney, crescent, or semi-circle in shape. It should be noted that the port may be implemented in one or more shapes. For example, the port may be a notch, ellipse, kidney, crescent, circle, or semi-circle in shape. The port may be offset from the central axis 104 or may be located on the central axis 104.

In some examples, the input recess 100 may include a static portion. The static portion may be a portion of the input recess 100 that remains static while another portion of the input recess 100 rotates. For example, the static portion may include all or a part of the end (e.g., bottom) of the input recess 100. A rotating portion of the input recess 100 may be a side part of the input recess 100. The static portion may remain stationary while the rotating portion may rotate about the central axis 104. In some examples, the static portion may include the port. In some examples, the input recess 100 may include a protruding port (e.g., elevated with respect to the bottom of the input recess). For example, the protruding port may be tubular structure with non-zero height. The static portion (e.g., protruding port, tube, etc.) may engage a static cover of the print particle replenishment device. For example, the protruding port may fit into an interfacing structure (e.g., notch, hole, etc.) of the print particle replenishment device. Accordingly, the port may serve as a keying feature and as a communication (e.g., transfer, delivery) feature in some examples. The contact(s) 106 may rotate relative to the static portion. In some examples, the contact(s) of the print particle replenishment device may rotate into contact with the contact(s) 106 of the input recess 100.

When connected with one or more contacts of a print particle replenishment device, the contact(s) 106 may be coupled to a memory device and/or electronic circuitry of the print particle replenishment device. For example, the print particle replenishment device may include a memory device and/or electronic circuitry. The contact(s) 106 may carry and/or receive one or more signals. For example, the contact(s) 106 may carry and/or receive one or more authentication signals and/or one or more dispense signals. In some examples, the memory device may store one or more authentication codes and/or algorithms. The input recess 100 may receive an authentication code via one or more contacts 106 and/or may receive one or more authentication algorithm signals via one or more contacts 106.

In some examples, a memory device may be implemented in Electrically Erasable Programmable Read-Only Memory (EEPROM). For example, a memory device may be implemented as an EEPROM integrated circuit (e.g., chip or board). Other kinds of memory may be implemented in other examples. As described herein, the memory device may store authentication data and/or dispense data.

In some examples, print particle dispense detection may be indicated via the contact(s) 106. Accordingly, the control device may detect when the print particles have been dispensed (e.g., completely dispensed). For example, when a syringe plunger has been completely inserted into the print particle replenishment device, a switch or contact within the print particle replenishment device may close, which may cause a dispense signal to be received via one or more contacts 106. In some examples, the closure of the switch or contact may change a value in the memory device, which may be indicated via one or more contacts 106 with a dispense signal.

In some examples, one or more of the features (e.g., structures, portions, recesses, planes, disks, covers, etc.) described herein may relate to an input direction (e.g., may be perpendicular to the input direction, may be parallel to the input direction, may rotate with respect to the input direction, etc.) instead of a central axis or rotating axis. In some examples, the input direction may be a general direction of print particle flow (e.g., downstream into the port). In some examples, the general direction of print particle flow may be generally in the direction of gravity when the input recess 100 is in a level position. For example, the input recess 100 may be oriented level (e.g., perpendicular) with respect to gravity. In other examples, the input recess 100 may be oriented in different orientations.

Figure 2C:
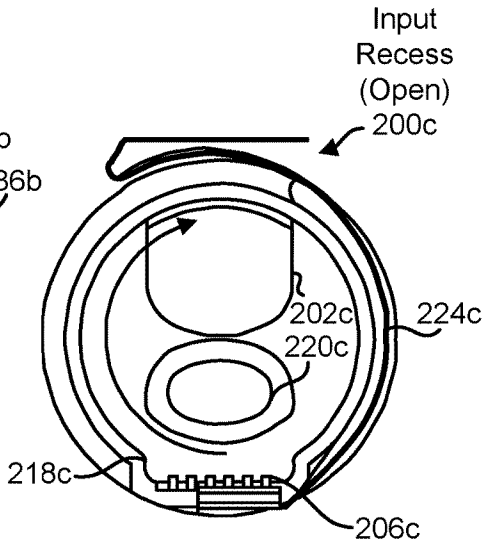
FIG. 2C is a top elevational view of an example of an input recess in an open position.
Figure 2B:
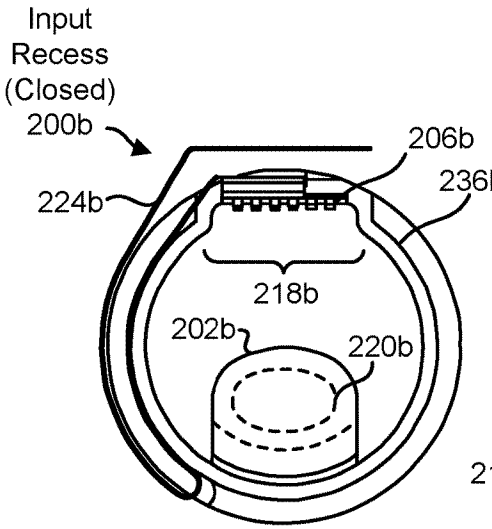
FIG. 2B is a top elevational view of another example of an input recess.
Figure 2A:
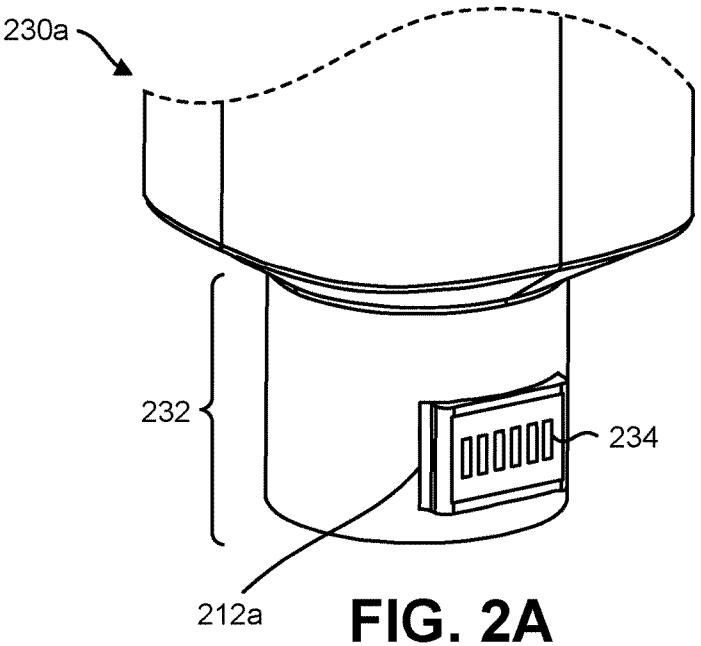
FIG. 2A is a perspective view of an example of a print particle replenishment device.

FIG. 2A is a perspective view of an example of a print particle replenishment device 230*a*. In this example, the print particle replenishment device 230*a* includes an output assembly 232 that is a cylindrical output neck. In this example, the output assembly 232 includes a protruding structure 212*a* of the outer portion of the output assembly 232. Examples of contact pads 234 are also illustrated in FIG. 2A. Although six contact pads 234 are illustrated, the same or a different number of contact pads may be implemented. In some examples, the contact pads 234 may be disposed directly on the protruding structure 212*a*. In other examples, the protruding structure 212*a* may house a board (e.g., printed circuit board (PCB), logic board, etc.) on which the contact pads 234 may be disposed. Authentication and/or dispense indicating functions may be provided by the board. The protruding structure 212*a* may act as a locking and/or alignment feature, to lock onto an input recess and/or to align with an input recess.

The protruding structure 212*a* may interlock with a rotating counterpart structure (e.g., ring of a port cover) to maintain continuous contact (during engagement and rotation, for example) between the contact pads 234 and counterpart contacts of the input recess (e.g., host device). The protruding structure 212*a* may allow the print particle replenishment device to be more securely locked into the host device (e.g., input recess). Maintaining continuous contact (for authentication and/or dispense detection) may allow for increased security. For example, maintaining continuous contact may help to prevent efforts to defeat (e.g., circumvent, break, etc.) authentication and/or dispense detection. In some examples, all authentication contact pad(s) and/or dispense indication contact pad(s) may be located on the protruding structure 212*a*.

In some examples, board (e.g., authentication board and/or contacts) may be located on either side of the port (depending what is better for connecting with the printer, for example). A cartridge may also be authenticated in the same location in some examples.

FIG. 2B is a top elevational view of another example of an input recess 200*b*. The input recess 200*b* described in connection with FIG. 2B may be an example of the input recess 100 described in connection with FIG. 1. In FIG. 2B, the input recess 200*b* is in a closed position. In this example, the input recess 200*b* includes contacts 206*b*. It should be noted that although six contacts 206*b* are illustrated, the same or a different number of contacts may be implemented. The contacts 206*b* may be corresponding or counterpart contacts 206*b* to the contact pads 234 of the print particle replenishment device 230*a*. In this example, the input recess 200*b* includes a rotating portion 236*b* that includes the contacts 206*b*. For example, the input recess 200*b* includes a slot 218*b* to receive the protruding structure 212*a* of the print particle replenishment device 230*a*. When inserted into the input recess 200*b*, the protruding structure 212*a* may engage the rotating portion 236*b* (e.g., rotating counterpart) of the input recess 200*b* (e.g., host device). For example, the protruding structure 212*a* may engage the slot 218*b* to rotate the rotating portion 236*b* of the input recess 200*b*.

In this example, the input recess 200*b* includes a port cover 202*b* and a port 220*b*. When in the closed position, the port cover 202*b* covers the port 220*b*. A service loop 224*b* is coupled to the contacts 206*b* in the example illustrated in FIG. 2B. The service loop 224*b* may be a flexible conductor. For example, the service loop 224*b* may extend during an opening rotation of the port cover 202*b*. For example, the service loop 224*b* may enable the contacts 206*b* to rotate with the rotating portion 236*b* of the input recess 200*b* and the print particle replenishment device 230*a*, which may allow continuous contact between one or more of (e.g., all of) the contact pads 234 and one or more of (e.g., all of) the contacts 206*b*. In some examples, the service loop 224*b* may be a flexible circuit to accommodate a range of motion (e.g., 90 degree rotation, 180 degree rotation, etc.) of the rotating portion 236*b*, the print particle replenishment device 230*a* (e.g., output assembly 232) and/or the port cover 202*b*. In the example illustrated in FIG. 2B, the contact pads 234 of the print particle replenishment device 230*a* may maintain contact and/or connection with the host device contacts 206*b* during (e.g., throughout) rotation.

In some examples, the contacts 206*b* may be spring contacts mounted with surface mount technology (SMT) to a flexible circuit. The flexible circuit may be attached to the rotating portion 236*b* (e.g., ring) with pressure sensitive adhesive (PSA). In some examples, all of the contacts 206*b* may be disposed as part of the rotating portion 236*b* opposite the port cover 202*b*.

FIG. 2C is a top elevational view of an example of an input recess 200*c* in an open position. The input recess 200*c* illustrated in FIG. 2C may be the input recess 200*b* illustrated in FIG. 2B after the output assembly 232 has rotated while engaged with the input recess 200*b*. In this example, the input recess 200*c* is in an open position after a 180 degree rotation. As can be observed, the contacts 206*c*, slot 218*c*, and port cover 202*c* have rotated and the service loop 224*c* has extended to accommodate the rotation. When in the open position, the port 220*c* is uncovered.

Figure 2D:
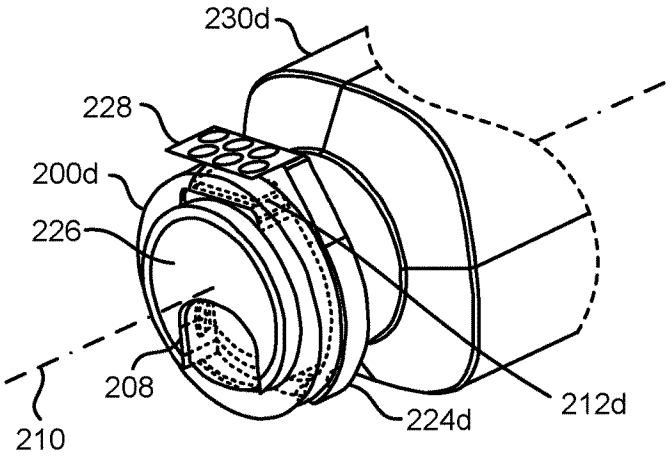
FIG. 2D is a perspective view of an example of a print particle replenishment device and an input recess.

FIG. 2D is a perspective view of an example of a print particle replenishment device 230*d* and an input recess 200*d*. In this example, the print particle replenishment device 230*d* is engaged with the input recess 200*b*. While the input recess 200*d* may be part of or attached to a host device (e.g., cartridge, printer, etc.), the perspective view of FIG. 2D illustrates a portion of the input recess 200*d*. FIG. 2D also illustrates rotating axis 210, a service loop 224*d*, and a channel 208 of the print particle replenishment device 230*d*. One end of the service loop 224*d* may be coupled to a protruding structure 212*d*. Another end of the service loop 224*d* may be (or may be coupled to) a contact interface 228 in some examples. For example, the contact interface 228 may be in communication with a control device (e.g., logic board on a cartridge and/or printer).

The control device may communicate (for authentication and/or dispense indication, for example) with a memory device and/or electronic circuitry in the print particle replenishment device via the contact interface 228, service loop 224*d*, input recess contacts, and/or print particle replenishment device 230*d* contact pads. In some examples, the contact interface 228 may be a print particle replenishment device authentication point and a cartridge authentication point. In the example illustrated in FIG. 2D, the channel 208 is a notch. In this example, a static portion 226 of the print particle replenishment device 230*d* is a disk that remains static relative to an input recess port (e.g., port 220*b*) while the output assembly and protruding structure 212*d* rotate about the rotating axis 210.

Figure 3B:
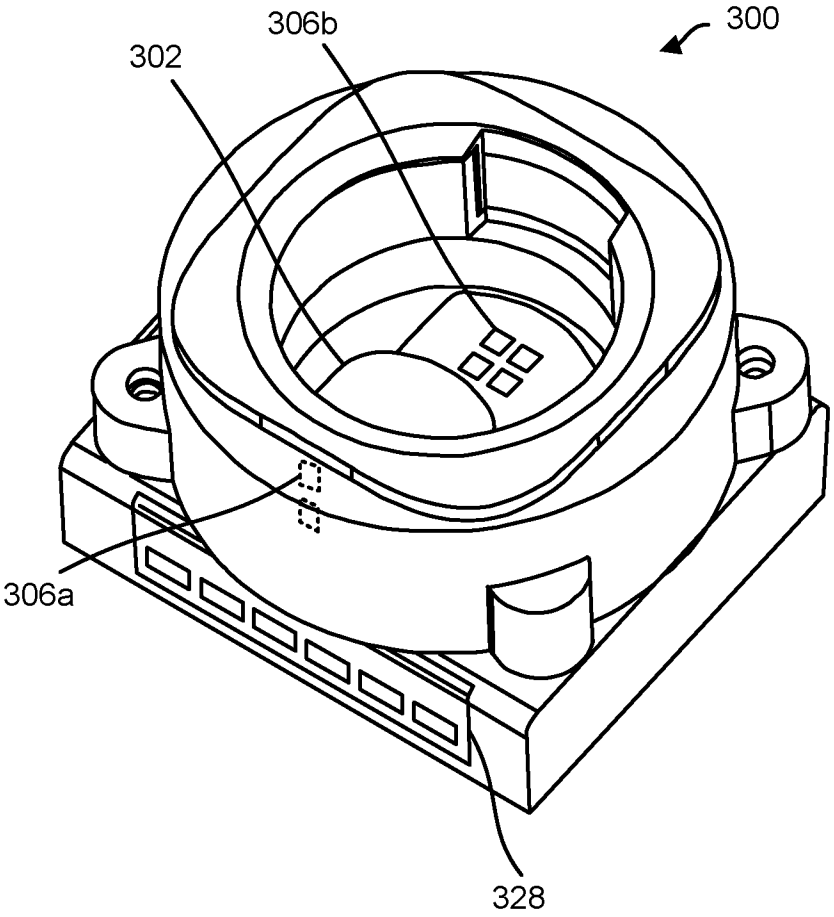
FIG. 3B is a perspective view of another example of an input recess.
Figure 3A:
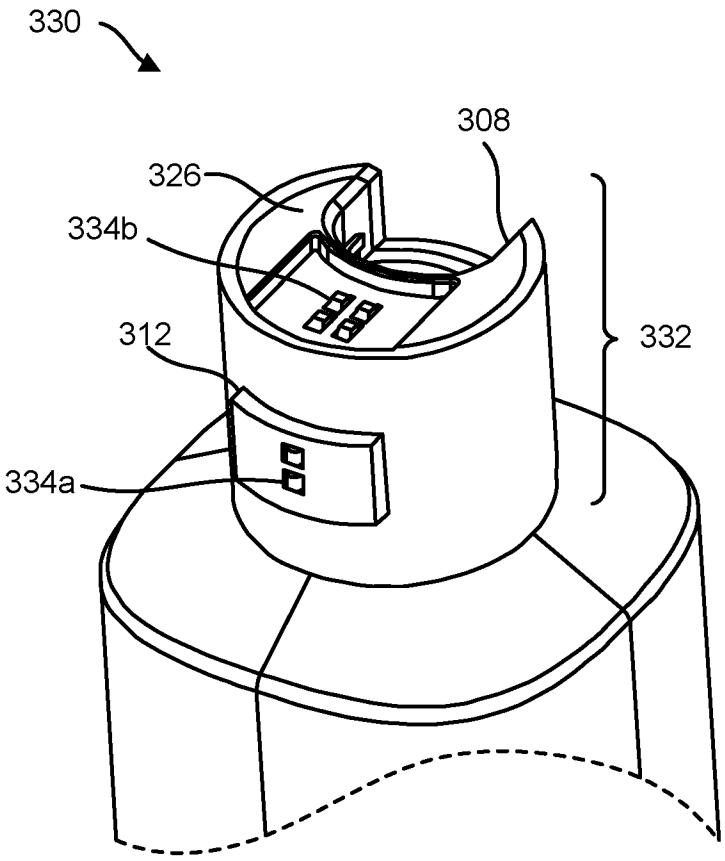
FIG. 3A is a perspective view of another example of a print particle replenishment device.

FIG. 3A is a perspective view of another example of a print particle replenishment device 330. In this example, the print particle replenishment device 330 has an output assembly 332 that includes a protruding structure 312 of the outer portion of the output assembly 332. An example of a first subset of contact pads 334*a* and an example of a second subset of contact pads 334*b* are illustrated in FIG. 3A. The first subset of contact pads 334*a* is disposed on a side of the output assembly 332 and a second subset of contact pads 334*b* is disposed on an end (e.g., bottom) of the output assembly 332. For example, the second subset of contact pads 334*b* may be disposed on a static portion 326 of the print particle replenishment device 330.

In some examples, the first subset of contact pads 334*a* may include dispense indication contact pads and the second subset of contact pads 334*b* may include authentication contact pads. In the example of FIG. 3A, the channel 308 is offset from a rotating axis of the print particle replenishment device 330. In this example, the second subset of contact pads 334*b* is offset from the rotating axis of the print particle replenishment device. The second subset of contact pads 334*b* may remain in a static position (e.g., in situ) while a rotating portion of the output assembly 332 (with the first subset of contact pads 334*a*, for example) rotates about the rotating axis. Although six contact pads 334*a-b* are illustrated, the same or a different number of contact pads may be implemented. In some examples, one subset of contact pads may be utilized for dispense indication while another subset of contact pads may be utilized for authentication. For example, the first subset of contact pads 334*a* may carry and/or communicate a dispense indication signal and the second subset of contact pads 334*b* may carry and/or communicate an authentication signal.

In some examples, contact pads utilized for authentication may maintain a constant or continuous connection during engagement. For example, the second subset of contact pads 334*b* may maintain a constant connection during engagement (e.g., during refill) by connecting through the end of the output assembly 332. The second subset of contact pads 334*b* may remain static during movement of the rotating portions of the print particle replenishment device 330. In an example, the first subset of contact pads 334*a* may be located on the side of the output assembly, which may simplify the electronic design of the print particle replenishment device 330.

In the example illustrated in FIG. 3A, the channel 308 is a notch. In this example, a static portion 326 of the print replenishment device is a disk that remains static relative to an input recess (e.g., host device) port while the output assembly 332 and protruding structure 312 rotate about the rotating axis.

In some examples, the first subset of contact pads 334*a* (e.g., dispense indication contact pads) makes a connection in the docked position (when dispensing occurs, for example). This may allow for easier access for dispense detection. The first subset of contact pads 334*a* may be spring contacts that lead to structure and/or circuitry (e.g., switch, contacts) for detecting print particle dispensing. For example, when the print particle replenishment device 330 is initially engaged (e.g., inserted into an input recess), the first subset of contact pads 334*a* (e.g., spring contacts) may not be in contact with corresponding contacts on the host device. The first subset of contact pads 334*a* may contact (e.g., deflect) the corresponding contacts in the input recess (e.g., host device) once rotated and docked.

FIG. 3B is a perspective view of another example of an input recess 300. In FIG. 3B, the input recess 300 is in a closed position. In this example, the input recess 300 includes a second subset of contacts 306*b* corresponding to the second subset of contact pads 334*b*. The second subset of contact pads 334*b* may maintain a connection and/or contact with the second subset of contacts 306*b* through rotation of the output assembly 332 in the input recess 300.

A first subset of contacts 306*a* corresponding to the first subset of contact pads 334*a* shown in FIG. 3B. For example, upon rotating the output assembly 332 within the input recess 300 by 180 degrees, the first subset of contact pads 334*a* may come into contact with the first subset of contacts 306*a* in the input recess 300 (e.g., host device). This is one example of intermittent contact or connection.

In this example, the input recess 300 includes a port cover 302. When in the closed position, the port cover 302 covers a port. The contacts (e.g., first subset of contacts 306*a* and second subset of contacts 306*a*) may be coupled to a contact interface 328 in some examples. For example, the contact interface 328 may be in communication with a control device (e.g., logic board on a cartridge and/or printer).

In some examples, an input recess (e.g., host device) may include circuitry (e.g., a memory device and/or electronic circuitry) to communicate print particle replenishment device authentication data and host device authentication data. For example, an input recess (e.g., host device) may include a memory device and/or electronic circuitry (not to be confused with a memory device and/or electronic circuitry of a print particle replenishment device, for instance). For example, the input recess (e.g., port assembly) may include a memory device and/or electronic circuitry. The memory device and/or electronic circuitry may be utilized to authenticate the host device (e.g., cartridge). For example, authentication and/or dispense detection of a print particle replenishment device and authentication of a host device may be combined (e.g., integrated). In some examples, contacts on the input recess may enable passing one or more print particle replenishment device authentication signals, passing one or more print particle replenishment device dispense signals, and/or providing one or more host device (e.g., cartridge) authentication signals (e.g., sending host device authentication data). In some examples, a contact interface (e.g., contact interface 328) may include and/or may be coupled to a memory device and/or other circuitry.

In some examples, one or more contacts of the contact interface 328 may carry and/or receive one or more signals. For example, the contacts of the contact interface 328 may carry and/or send one or more authentication signals and/or one or more dispense signals. In some examples, the memory device of the input recess (e.g., host device, cartridge, etc.) may store one or more authentication codes and/or algorithms. An input recess (e.g., input recess 100, 200*c-d*, and/or 300) may send an authentication code via one or more contacts of the contact interface 328 and/or may receive one or more authentication algorithm signals via one or more contacts of the contact interface 328.

In some examples, print particle dispense detection may be indicated (e.g., passed) via the contacts of the contact interface 328. Accordingly, the control device may detect when the print particles have been dispensed (e.g., completely dispensed). For example, when a syringe plunger has been completely inserted into the print particle replenishment device, a switch or contact within the print particle replenishment device may close, which may cause a dispense signal to be received via one or more contacts 306*a* and/or sent via one or more contacts of the contact interface 328. In some examples, the closure of the switch or contact may change a value in the memory device of the input recess, which may be indicated via one or more contacts of the contact interface 328 with a dispense signal.

Figure 4B:
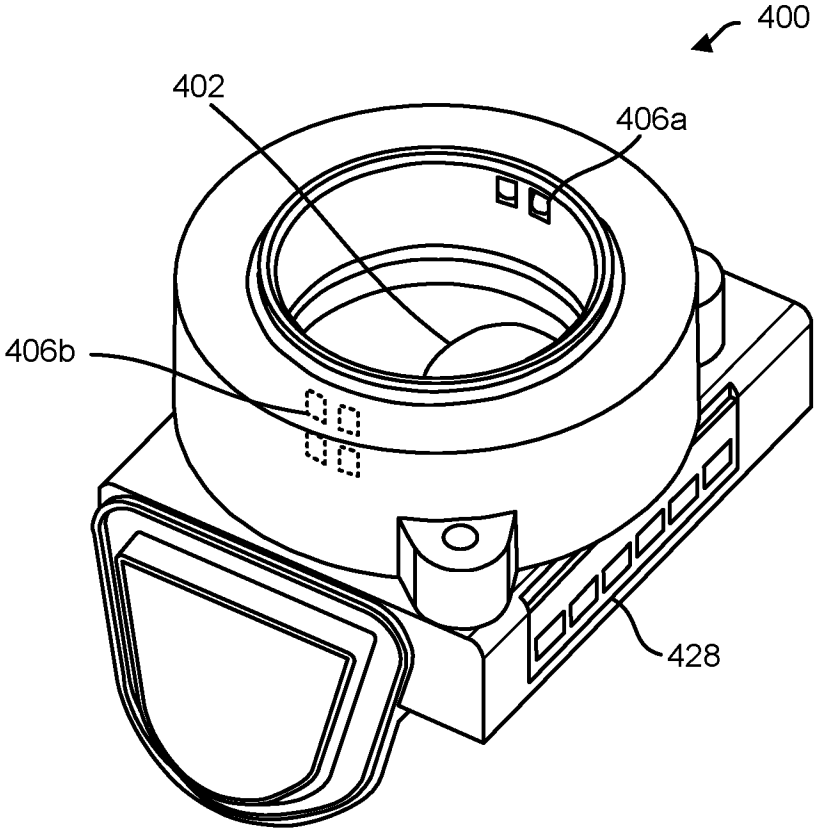
FIG. 4B is a perspective view of another example of an input recess.
Figure 4A:
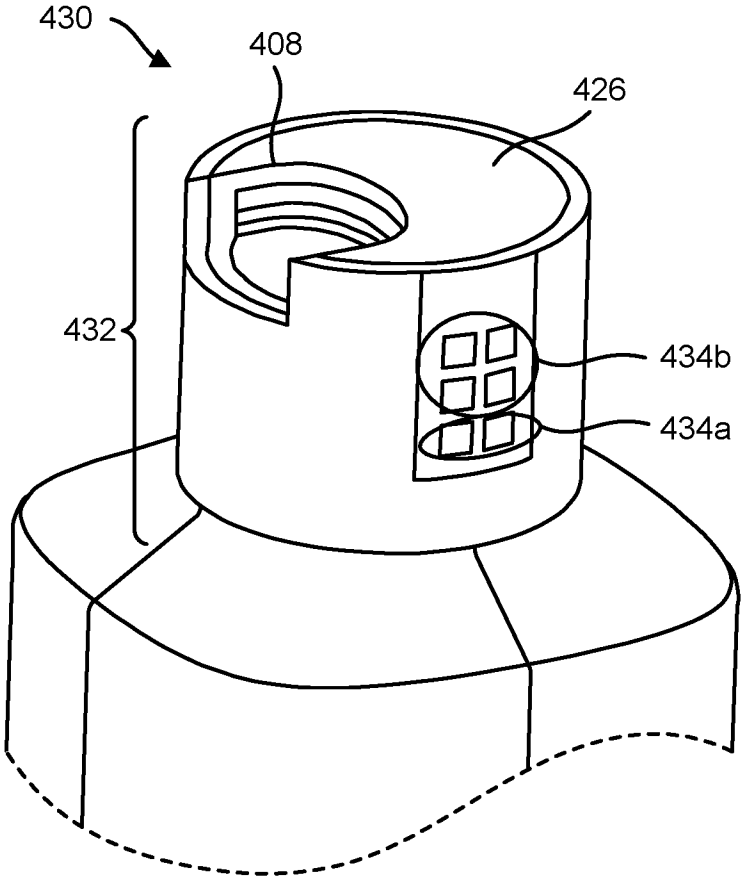
FIG. 4A is a perspective view of another example of a print particle replenishment device.

FIG. 4A is a perspective view of another example of a print particle replenishment device 430. In this example, the print particle replenishment device 430 has an output assembly 432 that includes a set of contact pads 434*a-b*. An example of a first subset of contact pads 434*a* and an example of a second subset of contact pads 434*b* are illustrated in FIG. 4A. The first subset of contact pads 434*a* and the second subset of contact pads 434*b* are disposed on a side of the output assembly 432. In some examples, the first subset of contact pads 434*a* may include dispense indication contact pads and the second subset of contact pads 434*b* may include authentication contact pads. The set of contact pads 434*a-b* may rotate about the rotating axis. Although six contact pads 434*a-b* are illustrated, the same or a different number of contact pads may be implemented. In some examples, one subset of contact pads may be utilized for dispense indication while another subset of contact pads may be utilized for authentication. For example, the first subset of contact pads 434*a* may carry and/or communicate a dispense indication signal and the second subset of contact pads 434*b* may carry and/or communicate an authentication signal.

In the example illustrated in FIG. 4A, the first subset of contact pads 434*a* and the second subset of contact pads 434*b* may be intermittent contacts. For example, the second subset of contact pads 434*b* may contact counterpart or corresponding contacts upon engagement with a host device (e.g., upon insertion of the output assembly 432 into an input recess). This may enable a control device (e.g., host device) to authenticate the print particle replenishment device 430 and unlock the input recess. Upon rotation, the second subset of contact pads 434*b* may disconnect from the counterpart or corresponding contacts of a host device. For example, four authentication contact pads 434*b* may touch off on the corresponding port contacts. This may allow the initial authentication to unlock the port but may not maintain connection throughout replenishment.

In an example, the first subset of contact pads 434*a* may not contact counterpart or corresponding contacts upon engagement with a host device (e.g., upon insertion of the output assembly 432 into an input recess). Upon rotation, the first subset of contact pads 434*a* may connect with counterpart or corresponding contacts of an input recess (e.g., host device). For example, two dispense detect contact pads 434*a* may touch off on the corresponding input recess contacts once in the docked position. This may allow a dispense detection mechanism (e.g., switch, contacts, and/or memory device) to communicate via the input recess contacts (with the host device, for example).

In the example illustrated in FIG. 4A, the channel 408 is a notch. In this example, a static portion 426 of the print replenishment device is a disk that remains static relative to an input recess port while the output assembly 432 and contact pads 434*a-b* rotate about the rotating axis. In the example of FIG. 4A, the contact pads 434*a-b* are located laterally from the channel 408 angle (e.g., at an angular difference of 90 degrees).

FIG. 4B is a perspective view of another example of an input recess 400. In FIG. 4B, the input recess 400 is in a closed position. In this example, the input recess 400 includes a second subset of contacts 406*b* corresponding to the second subset of contact pads 434*b*. The second subset of contact pads 434*b* may establish a connection and/or contact with the second subset of contacts 406*b* upon engagement and before rotation of the output assembly 432 in the input recess 400.

A first subset of contacts 406*a* corresponding to the first subset of contact pads 434*a* is also shown in FIG. 4B. For example, upon rotating the output assembly 432 within the input recess 400 by 180 degrees, the first subset of contact pads 434*a* may come into contact with the first subset of contacts 406*a* on the input recess 400 (e.g., host device). This is one example of intermittent contact or connection. In some examples, one or more of the contacts 406*a-b* may be adapted to deflect in four directions (for insertion, rotation in two directions, and removal, for example). For example, each contact 406*a-b* may be a small formed sheet metal tab heat staked to the input recess. Wires may be utilized to connect the leads to the authentication board.

In this example, the input recess 400 includes a port cover 402. When in the closed position, the port cover 402 covers a port. The contacts (e.g., first subset of contacts 406*a* and second subset of contacts 406*b*) may be coupled to a contact interface 428 in some examples. For example, the contact interface 428 may be in communication with a control device (e.g., logic board on a cartridge and/or printer).

In some examples, two sets of leads and/or flexes are routed around the inside walls of the input recess 400. The two sets of leads may connect and/or correspond to print particle replenishment device authentication contacts and/or dispense detection contacts.

In some examples, locating cartridge authentication near the refill port allows the print particle replenishment device authentication to occur through contacts via the cartridge. This may be beneficial by making the input recess more compact and the print particle replenishment device simpler.

Figure 5B:
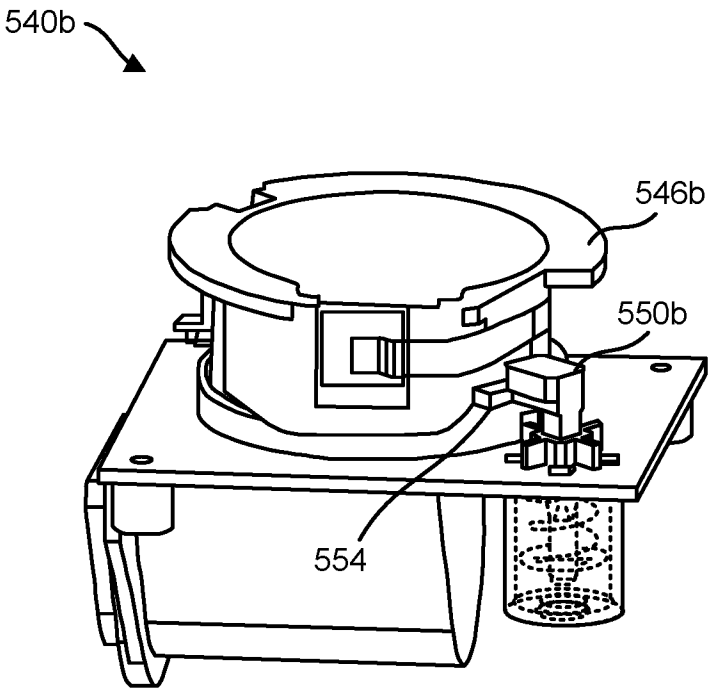
FIG. 5B is a perspective view of another example of a print particle input.
Figure 5A:
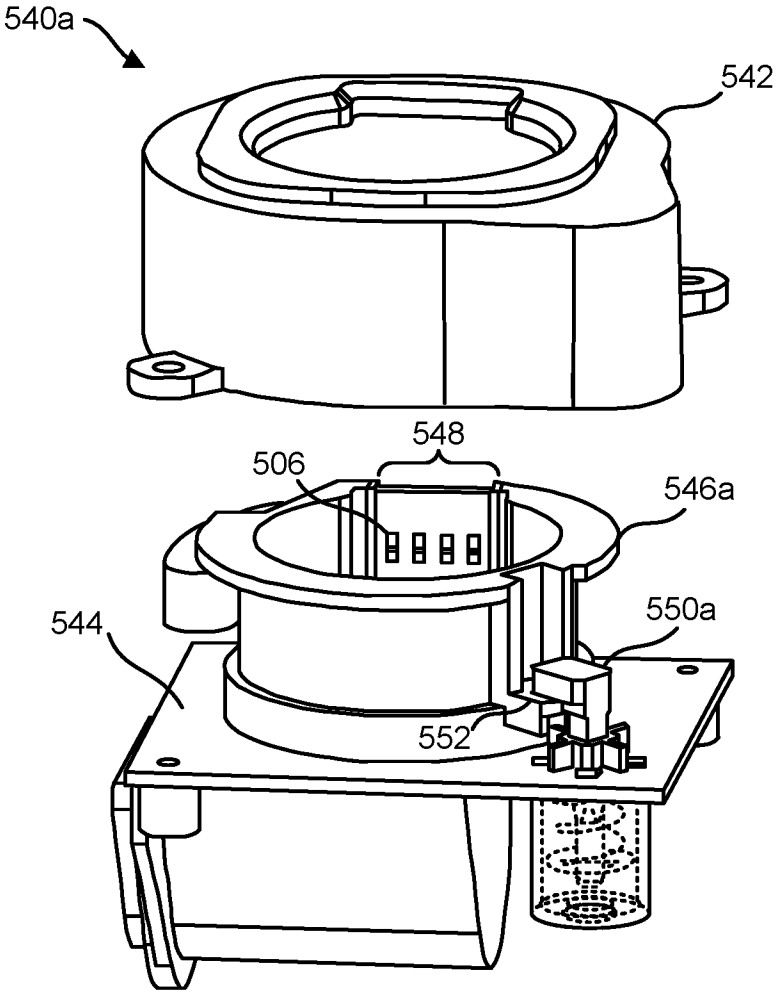
FIG. 5A is a perspective view of an example of a print particle input.

FIG. 5A is a perspective view of an example of a print particle input 540*a*. In the example of FIG. 5A, the print particle input 540*a* is in an undocked or closed state. The print particle input 540*a* may include a static base structure 544. The static base structure 544 may be part of and/or may be attached to a host device (e.g., cartridge, printer, etc.). In some examples, the static base structure 544 may remain stationary during print particle replenishment. For example, the static base structure 544 may include a bottom portion (e.g., floor) of an input recess.

The print particle input 540*a* may include a rotating annular structure 546*a*. The rotating annular structure 546*a* may be situated on the static base structure 544. For example, the rotating annular structure 546*a* may sit on the static base structure 544 within a protruding sleeve of the static base structure.

In some examples, the annular structure 546*a* may include a slot 548. The slot 548 may be adapted to engage a counterpart structure of a print particle replenishment device. For example, the print particle replenishment device may include a protruding structure on the side of an output assembly. In some examples, the slot 548 may receive and/or engage the protruding structure on the output assembly.

In some examples, the print particle input 540*a* may include a cap 542. The cap 542 may be attached to the static base structure 544. For example, the cap 542 may cover a portion of the rotating annular structure 546*a*. In some examples, the cap 542 may be adapted to keep a print particular replenishment device in the print particle input 540*a* when rotated. For example, the cap 542 may interfere with the protruding structure on an output assembly of a print particle replenishment device if removal is attempted when the print particle replenishment device has been rotated from an initial insertion position. In some examples, the cap 542, annular structure 546*a* and/or static base structure 544 may be parts of an input recess.

In some examples, the print particle input 540*a* may include one or more contacts 506. The contact(s) 506 may be disposed on an inner surface of the slot 548. The contact(s) 506 may be adapted to mechanically contact and rotate with one or more counterpart contact pads of a print particle replenishment device. For example, the contact(s) 506 may maintain connection with one or more corresponding contact pads on a print particle replenishment device during rotation of the annular structure 546*a*.

In some examples, the print particle input may include a locking mechanism 550*a* (e.g., a latch). The locking mechanism 550*a* may be adapted to lock and unlock the annular structure 546*a*. For example, when in a locked position, the locking mechanism 550*a* may prevent the annular structure 546*a* from rotating. When in an unlocked position, the locking mechanism 550*a* may allow the annular structure 546*a* to rotate. In some examples, the locking mechanism may include a spring to keep the locking mechanism in a locked position by default (unless actuated by the control device, for example). For example, the locking mechanism 550*a* (e.g., latch) may keep the port locked when no power is supplied to the host device (e.g., cartridge, printer power off, or cartridge removed from printer). In some examples, the locking mechanism may lock the print particle input in both the open and closed positions In some examples, the locking mechanism 550*a* may be adapted to disengage an interfering structure 552 of the annular structure 546*a* (e.g., an input recess) when authentication of a print particle replenishment device is successful. For example, a control device may perform an authentication operation based on the authentication data of a print particle replenishment device. In a case that the authentication operation is successful (e.g., the control device determines that the print particle replenishment device is authorized and/or authentic), the control device may control a mechanism (e.g., direct current (DC) motor) to actuate (e.g., raise) the locking mechanism 550*a*. For example, a spring loaded latch assembled into the bezel may ensure that the port remains locked until the print particle replenishment device (e.g., syringe) is authenticated and the DC motor raises the latch out of the way. In some examples, the authentication operation may be performed when a print particle replenishment device is inserted into the print particle input 540*a* (when authentication data is sent via the contact(s) 506, for example).

FIG. 5B is a perspective view of another example of a print particle input 540*b*. The print particle input 540*b* illustrated in FIG. 5B may be in a rotated (e.g., docked, open, etc.) state. For example, the print particle input 540*b* may be an example of the print particle input 540*a* of FIG. 5A, but in a rotated or docked state. It should be noted that the print particle input 540*b* of FIG. 5B is illustrated without a print particle replenishment device, although a print particle replenishment device may be engaged with the print particle input 540*b* when in a docked state. It should be noted that the print particle input 540*b* may include a cap as described in connection with FIG. 5A in some examples.

In some examples, the locking mechanism 550*b* may be adapted to engage with an interfering structure 554 (e.g., a second interfering structure) of the annular structure 546*b* (e.g., input recess) when the annular structure (e.g., rotating port cover) is in a docked position. For example, upon completing a rotation (e.g., 180-degree rotation or another range of rotation), the locking mechanism 550*b* (as controlled by the control device, for example) may engage with the interfering structure 554 to prevent the annular structure 546*b* from rotating, In some examples, when the port cover is rotated, the locking mechanism 550*b* (e.g., latch) is lowered and locks the port in its docked state until full dispensing is confirmed. This may allow delivery of the print particles while reducing leakage by keeping the print particle replenishment device aligned with the port.

In some examples, the locking mechanism 550*b* may be adapted to disengage with an interfering structure 554 (e.g., a second interfering structure) of the annular structure 546*b* (e.g., input recess) in response to an indication of print particle dispensing completion. For example, a control device may perform a dispense detection operation based on a dispense signal and/or dispense detection data of a print particle replenishment device. In a case that the dispense detection operation is successful (e.g., the control device determines that the print particle replenishment device has completed dispensing print particles), the control device may control a mechanism to actuate (e.g., raise) the locking mechanism 550*b*.

Figure 6:
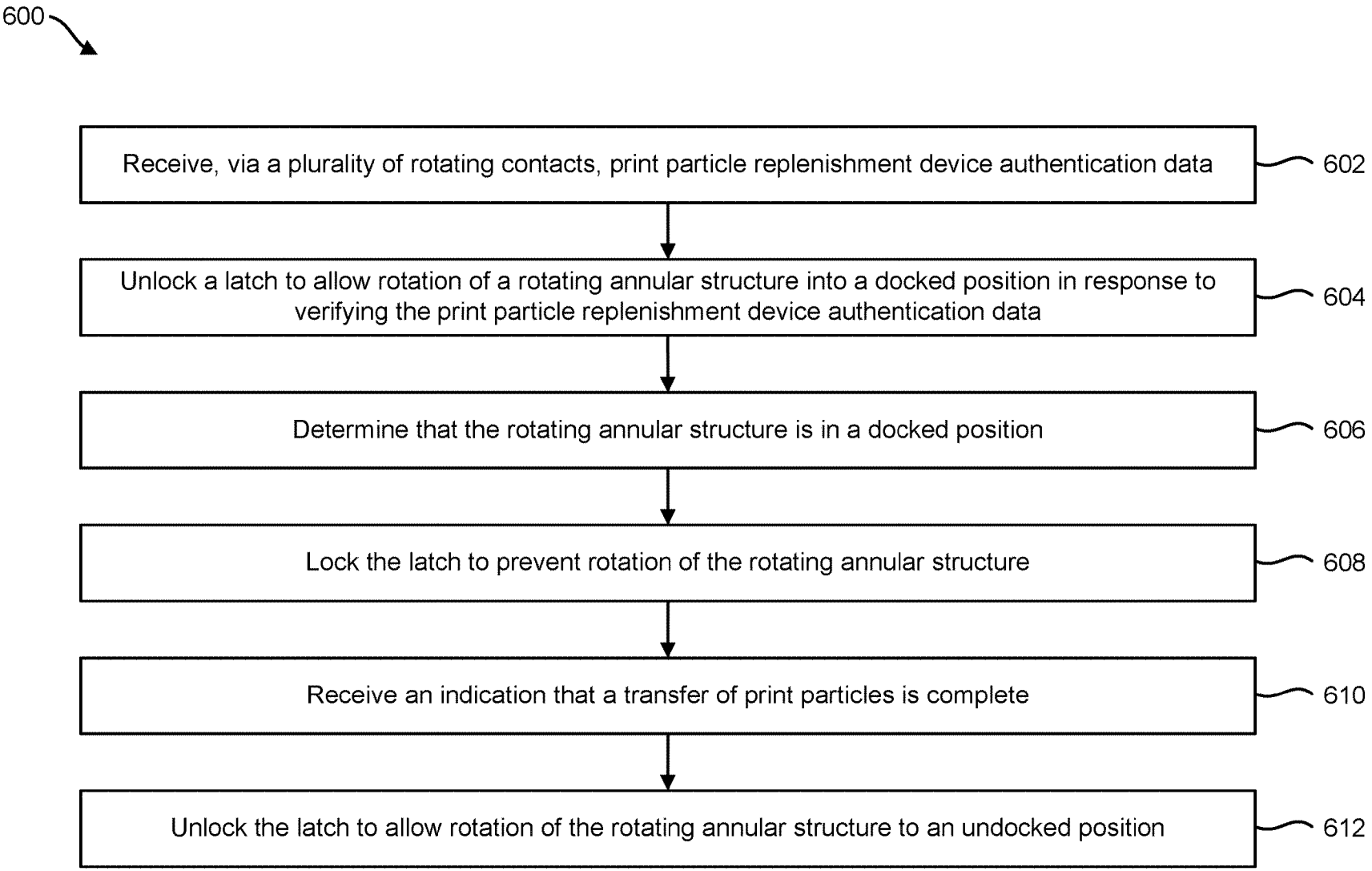
FIG. 6 is a flow diagram illustrating an example of a method for delivering print particles.

FIG. 6 is a flow diagram illustrating an example of a method 600 for delivering print particles. The method 600 may be performed by and/or with one or more of the input recesses 100, 200*b-d*, 300, 400, print particle inputs 540*a-b*, control devices, and/or host devices described herein.

Print particle replenishment device authentication data may be received 602 via a plurality of rotating contacts. For example, an input recess and/or host device (e.g., control device) may receive print particle replenishment device authentication data via one or more rotating contacts (e.g., contacts capable of rotation).

A latch may be unlocked 604 to allow rotation of a rotating annular structure into a docket position. In some examples, the latch may be unlocked in response to verifying the print particle replenishment device authentication data. For example, if an authentication operation on a control device is successful, the control device may control a mechanism to actuate the latch. This may allow a rotating annular structure to rotate to a docked position.

In some examples, it may be determined 606 that the rotating annular structure is in a docked position. In some examples, the rotating annular structure may actuate a switch mechanism when the docked position is reached. Actuation of the switch mechanism may indicate that the rotating annular structure is in the docked position. In some examples, the rotating annular structure may include a rotating electrical contact that comes into contact with a counterpart contact (e.g., stationary contact) on the input recess and/or host device to indicate docked position. For example, the rotating electrical contact may close a circuit with the counterpart contact when docked position is reached. In some examples, the print particle replenishment device may include one or more contact pads that come into contact with one or more counterpart contacts on the input recess and/or host device to indicate docked position. For example, the contact pad(s) may close a circuit with the counterpart contact(s) when docked position is reached. Additional or alternative approaches may be utilized to determine 606 that the rotating annular structure is in a docked position.

The latch may be locked 608 to prevent rotation of the rotating annular structure. For example, once the rotating annular structure arrives in a docked position, a control device may lock the latch.

An indication that a transfer of print particles is complete may be received 610. For example, an input recess and/or host device (e.g., control device) may receive a print particle replenishment device dispense indication (e.g., data) via one or more rotating contacts.

The latch may be unlocked 612 to allow rotation of the rotating annular structure to an undocked position. For example, an input recess and/or host device (e.g., control device) may unlock the latch in response to receiving 610 the indication that the transfer of print particles is complete.

In some examples, the method 600 may include sending the print particle device authentication data and printer cartridge authentication data to a printer. For example, print particle device authentication data and printer cartridge authentication data may be communicated to a printer (e.g., control device on a printer) via one more contact pads of a print particle replenishment device, via one or more contacts of an input recess, and/or via a contact interface.

The invention claimed is:

1. A host device comprising an input recess, the input recess comprising:

a rotating port cover offset from a central axis of the input recess; and a plurality of contacts disposed on an interfacing surface of the input recess to interface with a print particle replenishment device when the rotating port cover is rotated, wherein the plurality of contacts interfaces with a control device to authenticate the print particle replenishment device.

2. The host device of claim 1, wherein the plurality of contacts is to rotate with the rotating port cover.

3. The host device of claim 1, wherein a side portion of the input recess is to rotate with the print particle replenishment device while a bottom portion of the input recess is static.

4. The host device of claim 3, wherein the plurality of contacts is disposed on the side portion of the input recess.

5. The host device of claim 4, wherein a second plurality of contacts is disposed on the bottom portion of the input recess.

6. The host device of claim 1, wherein the input recess comprises a protruding port to engage a static cover of the print particle replenishment device.

7. The host device of claim 1, further comprising a service loop coupled to the plurality of contacts, the service loop to extend during an opening rotation of the rotating port cover.

8. The host device of claim 1, further comprising a locking mechanism to disengage an interfering structure of the input recess when authentication of the print particle replenishment device is successful.

9. The host device of claim 1, further comprising a locking mechanism to engage with an interfering structure of the input recess when the rotating port cover is in a docked position.

10. The host device of claim 9, wherein the locking mechanism is to disengage with the interfering structure of the input recess in response to an indication of print particle dispensing completion.

11. The host device of claim 1, further comprising circuitry to communicate print particle replenishment device authentication data and host device authentication data.

12. A printing device comprising a print particle input, the print particle input comprising:

a static base structure;

a rotating annular structure situated on the static base structure, the rotating annular structure comprising a slot to engage a counterpart structure of a print particle replenishment device; and a plurality of contacts disposed on an inner surface of the slot to mechanically contact and rotate with counterpart contact pads of the print particle replenishment device.

13. The printing device of claim 12, wherein the plurality of contacts is to maintain connection with a corresponding plurality of contacts pads on the print particle replenishment device during rotation of the rotating annular structure.

14. A method, comprising:

receiving, via a plurality of rotating contacts, print particle replenishment device authentication data;

unlocking a latch to allow rotation of a rotating annular structure into a docked position in response to verifying the print particle replenishment device authentication data;

determining that the rotating annular structure is in the docked position;

locking the latch to prevent rotation of the rotating annular structure;

receiving an indication that a transfer of print particles is complete; and unlocking the latch to allow rotation of the rotating annular structure to an undocked position.

15. The method of claim 14, further comprising sending the print particle replenishment device authentication data and printer cartridge authentication data to a printer.

16. A host device comprising an input recess, the input recess comprising:

a rotating port cover offset from a central axis of the input recess; and a plurality of electrical contacts disposed on an interfacing surface of the input recess to interface with a print particle replenishment device, wherein the plurality of contacts interfaces with a control device to authenticate the print particle replenishment device.

* * * * *